United States Patent [19]

Bishop et al.

[11] Patent Number: 4,548,527

[45] Date of Patent: Oct. 22, 1985

[54] ROOF SUPPORT SUITABLE FOR USE IN MINES

[75] Inventors: Christopher J. Bishop, Tewkesbury; Geoffrey M. Cumner, Brockworth; John H. Waters, Knutsford, all of England

[73] Assignee: Dowty Mining Equipment Limited, England

[21] Appl. No.: 622,844

[22] Filed: Jun. 21, 1984

Related U.S. Application Data

[63] Continuation-in-part of Ser. No. 426,686, Sep. 29, 1982, abandoned, which is a continuation of Ser. No. 288,311, Jul. 30, 1981, abandoned.

[30] Foreign Application Priority Data

Aug. 6, 1980 [GB] United Kingdom ..... 8025566

[51] Int. Cl.[4] ..... E21D 15/14

[52] U.S. Cl. ..... 405/294; 405/293

[58] Field of Search ..... 405/291, 293, 294, 295, 405/296; 299/31, 33; 248/354 H, 357; 91/170 MP

[56] References Cited

U.S. PATENT DOCUMENTS

| | | | |
|---|---|---|---|
| 3,732,699 | 5/1973 | Stevenson | 405/294 |
| 4,124,984 | 11/1978 | Saunders | 405/293 |
| 4,266,892 | 5/1981 | Maykemper | 405/293 |

FOREIGN PATENT DOCUMENTS

| | | | |
|---|---|---|---|
| 1079110 | 8/1967 | United Kingdom | 405/293 |

*Primary Examiner*—Cornelius J. Husar
*Assistant Examiner*—Nancy J. Stodola
*Attorney, Agent, or Firm*—Hayes, Davis & Soloway

[57] ABSTRACT

A roof support suitable for use in mines comprises a main roof-supporting structure, a cantilever carried by the structure, an actuator and a link member through the intermediary of which the actuator is connected to one end portion of the cantilever for moving the cantilever between retracted and extended positions. The end portion of the cantilever has projections which come into engagement with an abutment when, upon advancing movement of the actuator, the cantilever reaches its fully extended position. The abutment and projections are so shaped that when they are in engagement they form pivot means about which the cantilever can be tilted. The link member is so formed and so connected to the cantilever that upon further advancing movement of the actuator the cantilever is caused to tilt about the pivot means into a roof-supporting position.

4 Claims, 6 Drawing Figures

ROOF SUPPORT SUITABLE FOR USE IN MINES

Figure 1:
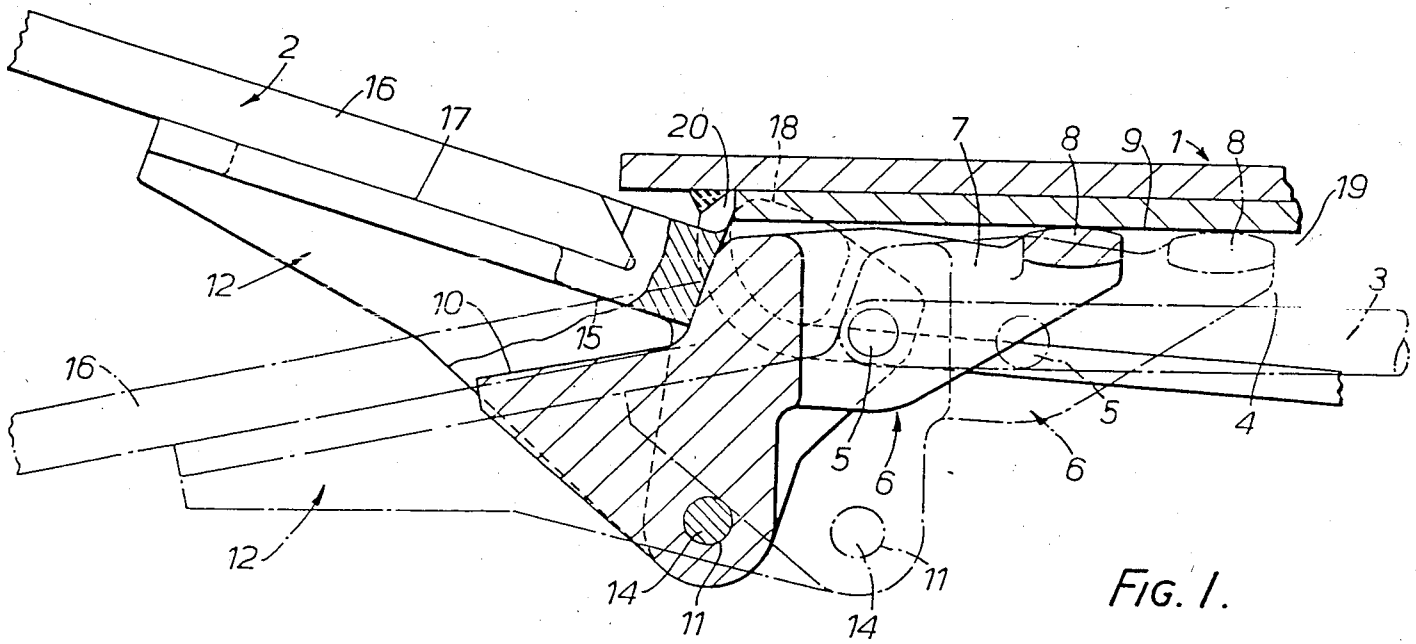

This application is in part a continuation of our copending application Ser. No. 426,686 filed Sept. 29, 1982 which was a continuation of Application Ser. No. 288,311 filed July 30, 1981, both now abandoned.

This invention relates to a roof support suitable for use in mines and having a cantilever which can be extended with respect to the main part of the support for roof-engagement and retracted when so required.

Hitherto various methods have been proposed for urging such a cantilever into positive engagement with the roof either during extension of the cantilever or when extension has been completed. However, in many cases the distances through which the cantilever could be urged towards the roof and also lowered away from the roof have been rather limited due to the forms of actuating linkage used. Certain such linkages and associated structures have been somewhat unwieldy, thus taking up much valuable space. Also, as well as providing a main actuator for extension and retraction of the cantilever, one or more further actuators have often been necessary to urge the cantilever towards the roof.

The present invention is intended to provide a remedy. It solves the problem of how to design a means for tilting such a cantilever, when so extended, which is compact in construction, which is capable of affording adequate lifting of the cantilever for satisfactory roof support, and which is capable of affording adequate downward articulation of the cantilever to negotiate relatively large roof steps.

According to the invention a roof support suitable for use in mines comprises a main roof-supporting structure, a cantilever carried by said structure, an actuator and a link member through the intermediary of which the actuator is connected to one end portion of the cantilever for moving the cantilever from a retracted position with respect to said structure to a fully extended position, and vice versa, said one end portion of the cantilever having a projection which comes into engagement with an abutment, fast with said structure, when upon advancing movement of said actuator said cantilever reaches said fully extended position, said abutment and said projection being so shaped that when so in engagement they together form pivot means about which the cantilever can be tilted, and said link member being so formed and so connected to said cantilever that upon further advancing movement of said actuator and link member the cantilever is caused to so tilt about said pivot means into a roof-supporting position.

The advantages offered by the invention are mainly that means for yielding of the cantilever can conveniently be provided in the actuator, the arrangement of the components is such that the setting and yielding loads of the cantilever are relatively independent of the cantilever angle, and the manner in which the link member is introduced into the construction results in a reduction in the overall length of the equipment.

Further only one actuator is required, serving not only for extension and retraction of the cantilever but also for the urging of the cantilever towards the roof.

Figure 2:
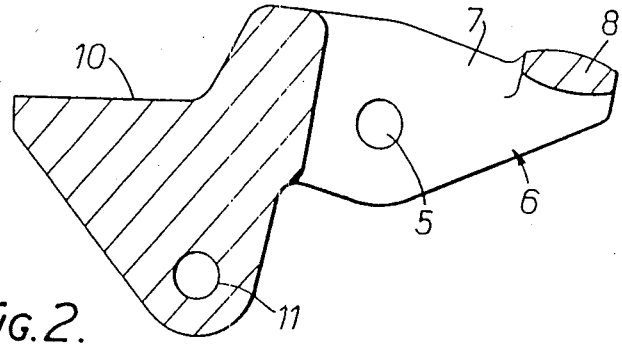
Figure 3:
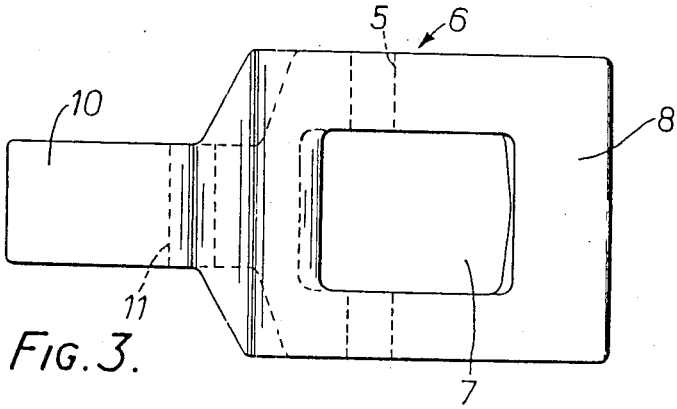
Figure 4:
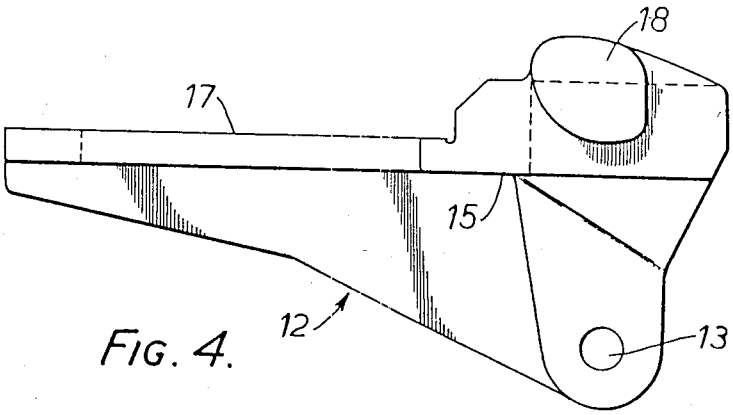
Figure 5:
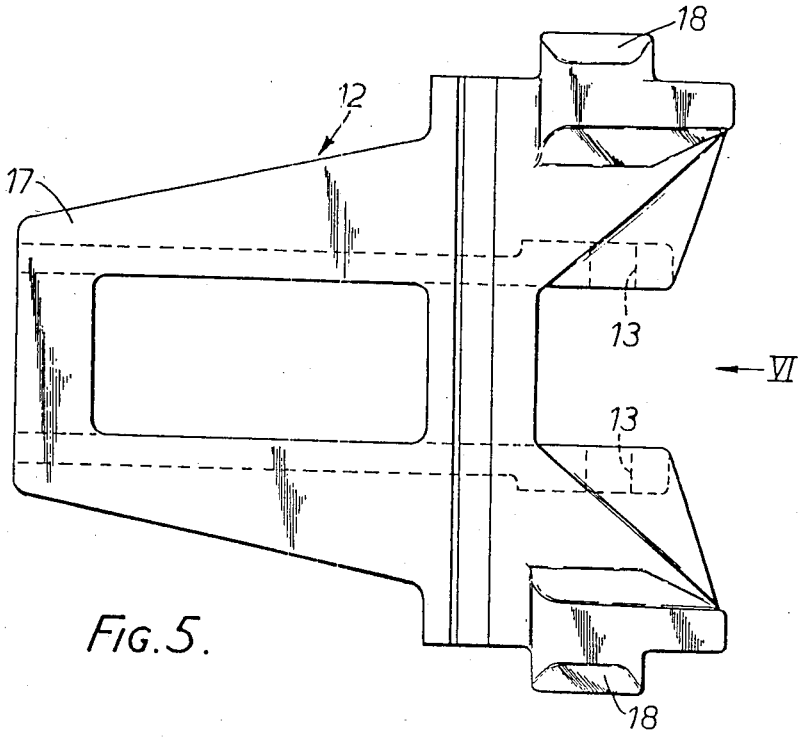
Figure 6:
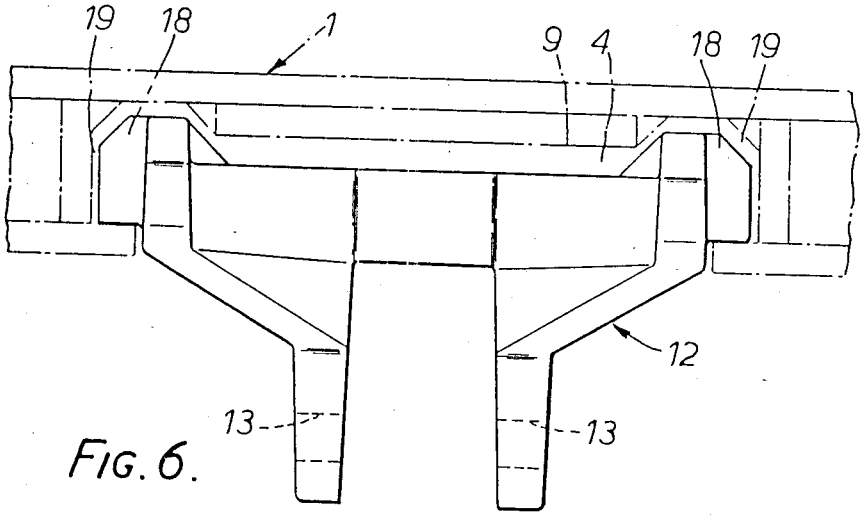

One way of carrying out the invention is described in detail below with reference to drawings which illustrate only one specific embodiment, in which:

FIG. 1 is a cross-sectional view of a part of a main roof-supporting structure and a part of a cantilever extending from that structure, FIG. 2 is a cross-sectional side elevation of a link member forming part of the construction shown in FIG. 1, FIG. 3 is a plan view of the link member shown in FIG. 2, FIG. 4 is a side elevation of an end casting forming part of the cantilever shown in FIG. 1, FIG. 5 is a plan view of the end casting shown in FIG. 4, and, FIG. 6 is a view taken in the direction of the arrow VI on FIG. 5.

FIG. 1 shows part of a roof-engageable canopy 1 which forms part of a main roof-supporting structure, and also shows part 2 of a cantilever carried by the structure. An actuator, in the form of an hydraulically-operable telescopic ram the piston rod of which is shown at 3, is disposed in a channel 4 formed on the underside of the canopy. The cylinder (not shown) of the ram is pivotally connected to the main roof-supporting structure and the piston rod 3 is pivotally connected at 5 by suitable means to a link member 6. The link member is of a shape more clearly seen in FIGS. 2 and 3, having an aperture 7 and an upstanding bridge-like formation 8 at its right-hand end portion which is intended slightly to engage the undersurface 9 of the canopy 1. The link member is also provided with a flat surface 10 and has a hole 11 at which it is pivotally connected to an end portion or casting 12, holes being suitably provided at 13 in the casting and a pivot pin 14 engaging the holes 11, 13 to form the connection.

The end casting 12 is provided with a flat undersurface 15 which is cooperable with the surface 10 of the link member 6, and a blade 16 is suitably retained upon the flat upper surface 17 thereof. The blade 16 and the end casting 12 thus together form a cantilever to which the piston rod 3 of the ram is connected through the intermediary of the link member 6.

The end casting, which is shown more clearly in FIGS. 4 to 6, includes two upstanding projections or ears 18, one extending outwardly from each side thereof. FIG. 6 shows how these projections are supported and guided in recesses 19 formed at the sides of the channel 4 of the canopy 1 to permit sliding of the end casting 12 together with the link member 6 along the channel by extending and retracting operation of the ram. The limit of full linear extension of the cantilever is defined by an abutment 20 with which the projections 18 come into engagement. As shown this abutment is of part-circular cross-sectional shape and those surfaces of the projections which come into engagement with the concave seating formed by the abutment are of complementary shape. Thus the abutment and projections together form pivot means about which the cantilever can tilt when at its position of full extension.

The canopy 1 is supported by one or more extensible and contractible props (not shown) which extend upwardly thereto form a mine-floor-engaging base (also not shown). A yield valve (again not shown) is provided in, or in association with, the ram.

In operation of the roof support above described upon movement of the piston rod 3 of the ram from its retracted position in the extending, advancing, direction, force is transmitted to the cantilever blade 16 by way of the link member 6 and the end casting 12. The formation 8 is held in engagement with, and slides along the length of, the undersurface 9 of the canopy 1. Simultaneously, the projections 18 slide along the lengths of the recesses 19. During consequent extending movement of the cantilever with respect to the main roof-supporting structure gravity keeps the front, free, end portion of the blade 16 of the cantilever depressed as shown in dotted detail in FIG. 1, but if there is any tendency for it to rise, for example as a result of friction, it would be constrained by the engagement of the projections 18 of the end casting 12 with the undersurface of the canopy 1.

When the projections 18 engage the abutment 20 the cantilever 2 has reached its position of full extension with respect to the main roof-supporting structure 1. However, in order now to lift the cantilever into effective roof-supporting engagement with the mine roof the ram is further advanced.

Since the formation 8 of the link member 6 is maintained in engagement with the undersurface 9 and the link member 6 thus cannot move in the anti-clockwise direction as viewed in FIG. 1, the link member 6 and pivot 5 move to the left. This motion of link member to the left (as seen in FIG. 1) also moves pivot pin 14 (connecting link member 6 and casting 12) to the left. Since ears 18, on casting 12, are held by abutment 20 this motion of pivot pin 14 to the left forces the casting 12 to move in a clockwise direction about the pivot means formed by the projections 18 and abutment 20, the surface 15 thus moving away from the surface 10 and the cantilever 2 being tilted upwardly.

When the cantilever has been set against the mine roof, the hydraulic valve (not shown) controlling the ram returns to the neutral position and the ram is held hydraulically locked in its extended condition. Excessive downward force applied by the roof to the cantilever when so set is accommodated by the yielding valve provided in the ram.

To retract the cantilever into the main roof-supporting structure, the ram is contracted by suitable operation of its control valve. Tension force applied to the pivotal connection 5 of the link member 6 commences to pull the link member 6 and cantilever 12 rearwardly. The effects of gravity on the cantilever and of the contracting force of the ram result in anti-clockwise rotation of the end casting 12 about the pivot means 18/20 and thus downward tilting of the cantilever. Thereafter, the surface 15 comes back into engagement with the surface 10, whereupon a straight pull is applied by the ram to the link member 6 and cantilever 12 so that it now moves to its retracted position with respect to the main structure.

In the above-described construction, by so arranging for the abutment 20 to be engaged, at full extension of the cantilever 2, by means (the projections 18) carried by the cantilever itself, we provide adequate capability for cantilever uplift. Further, the locus of the ram is substantially a straight horizontal line ensuring that the ram can be fitted inside a relatively shallow canopy and thus avoding the need to provide a deep section canopy with its attendant reduction in space available for travelling ways.

By our construction also, adequate downward articulation of the cantilever is afforded to negotiate relatively large roof steps, such as occur in mines following cutting operations, when advancing the main roof-supporting structure.

Our construction is such that the setting and yielding loads of the cantilever are relatively independent of cantilever angle. This applies to all configurations within the scope of this invention in so far as it affects setting loads and applies to those configurations with a yield valve in the ram or in the hydraulic circuit associated with the ram. The design is such that the leverage reaction point and its movement during cantilever operation can be so selected that the situation in which yield loads varying from maximum with cantilever fully set to a very low value with the cantilever tilted downwardly is avoided.

The invention is in no way limited to the provision of yielding means in or in association with the operating ram as in other embodiments, where it is desired to so lock the ram that yielding is not possible, such yielding means are simply omitted.

Although in the embodiment above-described with reference to the drawings upon the straight pull being applied by the contracting ram to the cantilever 16, the cantilever is tilted downwardly as shown in broken lines and moves to the retracted position in this attitude, in alternative embodiments of the invention means are provided for ensuring that during retraction the cantilever is moved to a position in which it lies substantially parallel to the roof-engaging surface of the canopy. For example, in one such alternative embodiment the surface 9, with which the formation 8 of the link member 6 is in engagement, may be so shaped in the region approaching the cylinder of the ram as, during retraction of the cantilever, to cause the link member to move in the clockwise direction about the pivot pin 14 sufficiently far as to set the cantilever in such position substantially parallel to the roof-engaging surface of the canopy. In another alternative embodiment the same effect may be achieved by providing a ramp on the main roof-supporting structure with which a surface of the cantilever itself comes into sliding engagement as it moves towards its retracted condition to control the cantilever attitude accordingly.

By the compact arrangement and design of components for transmitting ram force to the cantilever, a substantial reduction in the overall length of our equipment is provided.

We claim:

1. A roof support, suitable for use in mines, comprising a main roof-supporting structure having an abutment at one end thereof, a cantilever carried by said structure, an actuator, one part of which is connected to said structure, and a link member through the intermediary of which another part of said actuator is connected to a rear end portion of the cantilever for moving the cantilever from a retracted position with respect to said structure to a fully extended roof-engaging position, and vice versa, said link member being pivotally connected to said rear end portion of the cantilever and having an upstanding formation which slidingly engages the undersurface of a part of said main roof-supporting structure, said rear end portion of the cantilever having formed integrally therewith a projection extending therefrom and engageable with said abutment when the cantilever is fully extended, which projection is part circular in cross-sectional shape, and said abutment forming a seating having a matching part circular cross-sectional shape so that said projection and said abutment prevent further forward movement of said cantilever and together form a pivot means about which said cantilever can then be tilted with respect to said structure by said actuator, said link member being free to continue to slide with respect to said structure after said pivot means has formed, said continued movement of said link member serving to tilt said cantilever, wherein said link member is connected to a downward projection on said cantilever which is positioned immediately below said projection of part circular cross-sectional shape, and wherein said rear end portion of the cantilever has two of said projections of part circular cross-sectional shape extending therefrom by which it is slidingly supported and guided, said projections of part circular cross-sectional shape engaging recesses provided at the sides of a channel formed on the underside of said structure.

2. A roof support, suitable for use in mines, comprising a main roof-supporting structure having an abutment at one end thereof, a cantilever carried by said structure, an actuator, one part of which is connected to said structure, and a link member through the intermediary of which another part of said actuator is connected to a rear end portion of the cantilever for moving the cantilever from a retracted position with respect to said structure to a fully extended roof-engaging position, and vice versa, said link member being pivotally connected to said rear end portion of the cantilever and having an upstanding formation which slidingly engages the undersurface of a part of said main roof-supporting structure, said rear end portion of the cantilever having formed integrally therewith a projection extending therefrom and engageable with said abutment when the cantilever is fully extended, which projection is part circular in cross-sectional shape, and said abutment forming a seating having a matching part circular cross-sectional shape so that said projection and said abutment prevent further forward movement of said cantilever and together form a pivot means about which said cantilever can then be tilted with respect to said structure by said actuator, said link member being free to continue to slide with respect to said structure after said pivot means has formed, said continued movement of said link member serving to tilt said cantilever, wherein a portion of the link member extends beyond said projection of part circular cross-sectional shape and supportingly engages the undersurface of the cantilever before the cantilever is tilted to its roof engaging position.

3. A roof support suitable for use in mines, comprising a main roof-supporting structure having an abutment at one end thereof, a cantilever carried by said structure, an actuator, one part of which is connected to said structure, and a link member through the intermediary of which another part of said actuator is connected to a rear end portion of the cantilever for moving the cantilever from a retracted position with respect to said structure to a fully extended roof-engaging position, and vice versa, said link member being pivotally connected to said rear end portion of the cantilever and having an upstanding formation which slidingly engages the undersurface of a part of said main roof-supporting structure, said rear end portion of the cantilever having formed integrally therewith a projection extending therefrom and engageable with said abutment when the cantilever is fully extended, which projection is part circular in cross-sectional shape, and said abutment forming a seating having a matching part circular cross-sectional shape so that said projection and said abutment prevent further forward movement of said cantilever and together form a pivot means about which said cantilever can then be tilted with respect to said structure by said actuator, said link member being connected to a downward projection on said cantilever which is positioned immediately below said projection of part circular cross-sectional shape, a portion of the link member extending beyond said projection of part circular cross-sectional shape and supportingly engaging the undersurface of the cantilever before the cantilever is tilted to its roof engaging position.

4. The support of claim 3 wherein the upstanding formation of the link member is to the rear of the connection between the link member and the cantilever.

* * * * *